US009604084B2

(12) United States Patent
Kadoche

(10) Patent No.: US 9,604,084 B2
(45) Date of Patent: Mar. 28, 2017

(54) SPRINKLER COMPRISING A SHUTOFF MEMBER HELD IN POSITION BY A FUSIBLE MEMBER WITH THE AID OF A MOVEABLE BEARING MEANS

(71) Applicants: VACTEC, Saint Florent sur Cher (FR); Maurice Kadoche, Coubron (FR)

(72) Inventor: Maurice Kadoche, Coubron (FR)

(73) Assignees: VACTEC, Saint Florent sur Cher (FR); Maurice Kadoche, Coubron (FR)

( * ) Notice: Subject to any disclaimer, the term of this patent is extended or adjusted under 35 U.S.C. 154(b) by 0 days.

(21) Appl. No.: 14/769,683

(22) PCT Filed: Feb. 13, 2014

(86) PCT No.: PCT/FR2014/050281

§ 371 (c)(1),
(2) Date: Aug. 21, 2015

(87) PCT Pub. No.: WO2014/128385

PCT Pub. Date: Aug. 28, 2014

(65) Prior Publication Data

US 2015/0367156 A1 Dec. 24, 2015

(30) Foreign Application Priority Data

Feb. 21, 2013 (FR) ..... 13 51515

(51) Int. Cl.
*A62C 35/62* (2006.01)
*A62C 35/68* (2006.01)
(Continued)

(52) U.S. Cl.
CPC ..... *A62C 37/12* (2013.01); *A62C 35/62* (2013.01); *A62C 35/68* (2013.01); *A62C 37/14* (2013.01)

(58) Field of Classification Search
CPC ..... A62C 35/62; A62C 35/68; A62C 37/12; A62C 37/14
See application file for complete search history.

(56) References Cited

U.S. PATENT DOCUMENTS 1,996,077 A * 4/1935 Loepsinger ..... A62C 37/14 169/38
3,918,645 A * 11/1975 Mohler ..... B05B 1/265 169/37
(Continued)

FOREIGN PATENT DOCUMENTS

CH 662281 A5 9/1987
DE 3225798 A1 1/1984
(Continued)

OTHER PUBLICATIONS

International Search Report dated Aug. 22, 2014 for corresponding International Application No. PCT/FR2014/050281, filed Feb. 13, 2014.
(Continued)

*Primary Examiner* — Ryan Reis
(74) *Attorney, Agent, or Firm* — David D. Brush; Westman, Champlin & Koehler, P.A.

(57) ABSTRACT

A sprinkler is provided for a firefighting installation including a network of vacuum sprinklers. The sprinkler includes: a fixing connector, which allows the sprinkler to be connected to pipe work and has a nozzle; a fusible member; and a shutoff member for shutting off the nozzle, held in shutoff position by the fusible member. The fusible member is kept bearing against the shutoff member by a moveable bearing, capable of allowing the shutoff member to leave its shutting-off position when the pressure in the nozzle exceeds a predetermined pressure. An ejecting element for ejecting the
(Continued)

shutoff member is mounted outside the nozzle and acts in a pulling sense on the shutoff member.

8 Claims, 1 Drawing Sheet

(51) Int. Cl.
*A62C 37/12* (2006.01)
*A62C 37/14* (2006.01)

(56) References Cited

U.S. PATENT DOCUMENTS

| | | | | |
|---|---|---|---|---|
| 4,108,247 | A * | 8/1978 | Mohler | A62C 37/14 169/38 |
| 5,010,959 | A * | 4/1991 | Lostoski | A62C 37/14 169/37 |
| 6,854,668 | B2 * | 2/2005 | Wancho | B05B 1/265 169/37 |
| 2003/0000712 | A1 * | 1/2003 | Franson | A62C 35/62 169/17 |

FOREIGN PATENT DOCUMENTS

| | | | |
|---|---|---|---|
| FR | 2299877 | A1 | 9/1976 |
| FR | 2724323 | A1 | 3/1996 |

OTHER PUBLICATIONS

English translation of the Written Opinion dated Aug. 21, 2015 for corresponding International Application No. PCT/FR2014/050281, filed Feb. 13, 2014.

* cited by examiner

SPRINKLER COMPRISING A SHUTOFF MEMBER HELD IN POSITION BY A FUSIBLE MEMBER WITH THE AID OF A MOVEABLE BEARING MEANS

CROSS-REFERENCE TO RELATED APPLICATIONS

This Application is a Section 371 National Stage Application of

International Application No. PCT/FR2014/050281, filed Feb. 13, 2014, the content of which is incorporated herein by reference in its entirety, and published as WO 2014/128385 A2 on Aug. 28, 2014, not in English.

FIELD OF THE DISCLOSURE

The field of the invention is that of designing and manufacturing firefighting equipment and installations. More precisely, the invention relates to sprinklers that implement fusible members.

BACKGROUND OF THE DISCLOSURE

The role of an automatic fire extinguishing installation implementing sprinklers is to detect, as early as possible, the seat of a fire then to automatically trigger the extinction system, at least locally, this while emitting an alarm. The installation has for objective to contain the fire as much as possible, before the arrival of the fire brigade which then takes over the installation in order to extinguish the fire.

In the field of the invention, firefighting installations are classified into three categories, namely:

"wet-pipe" systems;

"dry-pipe" systems;

"vacuum" systems.

In these three systems, the sprinklers are mounted in a network in such a way as to be distributed evenly over the site to be protected. Conventionally, the sprinklers comprise:

- a fixing connector, that allows the sprinkler to be connected to pipework, with this fixing connector having a nozzle intended for the passage of water to be released in order to extinguish the fire;
- a fusible member;
- a shutoff member for shutting off the nozzle, held in the shutoff position by the fusible member.

The fusible member is calibrated to blow when a certain temperature has been exceeded, as such releasing the nozzle from its shutoff member.

In "wet-pipe" systems, the entire piping of the installation is filled with water, and this up to the sprinklers. The water is therefore on standby behind the shutoff means and when the fusible member blows, the water flows through the nozzle of the connector of the sprinkler of which the fusible member has blown.

The release time for the water is therefore immediate, which is particularly advantageous. On the other hand, "wet-pipe" systems, are not adapted for sites that have risks of freezing. Indeed, in case of freezing, the water cannot flow. In addition, the freezing can cause deteriorations to the piping of the installation (deformation and even bursting of the pipes). In certain cases, the installation is emptied of water. In other cases, the site to be protected is heated in order to prevent any risk of freezing. For sites to be protected that have a relatively substantial surface area, the consumption of energy, and consequently the heating bill, can be substantial, and even prohibitive. Another way to fight freezing is to add an antifreeze agent to the water of the installation, such as glycol which is a toxic and carcinogenic product.

In the "dry-pipe" systems, the entire installation is emptied of water. The entire piping of the installation is kept under pressure. When the fusible members blow, the air pressure is released by the sprinkler or sprinklers in question and the water, also under pressure, tends to "push" the air outside of the installation until it arrives at the orifice or orifices released in such a way as to escape through the latter.

With such a system, the water can in certain cases take up to 60 seconds to reach the sprinkler of which the fusible member is blown, which is of course compliant with the current standard but which can be excessively long with regards to certain incipient fires.

In addition, "dry-pipe" systems do not entirely overcome the problems linked to freezing. Indeed, condensation can be created in the piping of a "dry-pipe" installation, which can damage certain components of the installation and cause the protection to fail.

Generally, "wet-pipe" and "dry-pipe" systems have the following disadvantages:

- they are subject to forming slush and, consequently, to clogging;
- they are subject to corrosion, which can obviously lead to an installation partially or entirely out of use and cause the protection to fail;
- they can be the object of water leaks that cannot be seen;
- they allow the development of microorganisms in the pipes of the installation.

This results in that they require, among other things, antifreeze and anticorrosion treatments (involving recourse to harmful products).

Moreover, they require rinsing operations after use.

Furthermore, they imply putting into service times that are relatively long, according to the extent of the installation, which can range from one to four hours for "wet-pipe" systems and two hours and more for the "dry-pipe" systems.

In order to overcome all of these disadvantages, "vacuum" systems were designed. In "vacuum" systems, a vacuum is created in the pipes extending between a general valve and all of the sprinklers. In other terms, all of the pipes separating the valve from the sprinklers are in a vacuum.

In these systems, the vacuum constitutes an active energy which is used as a functional source in monitoring sprinklers. Indeed, if a fusible member of one of the sprinklers blows, the atmospheric pressure reaches the entire installation, which causes a change in the state of an actuator which, in turn, opens the general water inlet valve. Then the water quickly and without any obstacle invades the entire installation until the sprinklers, with the water flowing through the sprinkler or sprinklers of which the fusible member has blown. The vacuum which is still active in the networks quickly attracts the extinguishing water towards the sprinklers of which the fusible member has blown.

The triggering time of the actuator is very short, in that, when a fusible member blows, the "vacuum" installation immediately generates an aspiration phenomenon of the air outside of the installation. Note that this aspiration can be beneficial, as the aspiration effect on the seat of the fire tends to reduce the intensity of the latter.

The time for the water to arrive at the sprinkler of which the fusible member has blown is less than 60 seconds.

It is therefore understood that, due to the absence of water or of condensation in a "vacuum" system installation, the following results are obtained:

no corrosion, therefore no slush forming or clogging;

the guarantee of obtaining the density of extinguishing water required;

no development of microorganisms;

no water leaks possible (as the water is by default absent in the pipes of the installation that lead to the sprinklers);

no need for antifreeze agent or anticorrosion treatment;

no rinsing required before the installation is put into service.

Furthermore, as shall be explained in more detail in what follows, the time for putting an installation with a "vacuum" system into service takes place extremely quickly, under about one minute.

Conventionally, a sprinkler comprises:

a fixing connector, that allows the sprinkler to be connected to pipework, having a nozzle through which the water is intended to flow in case of triggering of the sprinkler;

a fusible member;

a shutoff member for shutting off the nozzle, held in the shutoff position by the fusible member.

The operation of these sprinklers is well known to those skilled in the art. The fusible member is constituted by an ampoule enclosing a liquid and an air bubble; when the fusible member is subjected to a predetermined temperature, the air bubble expands to the point of bursting the ampoule, which then releases the shutoff member from the retaining force exerted until then by the fusible member.

In "wet-pipe" systems, the water pushes the shutoff member and ejects the latter. In "dry-pipe" systems, it is the air which exerts a thrust in a first time on the shutoff member in order to eject the latter.

In "vacuum" systems, the means for ejecting are mounted on the sprinklers in such a way as to eject the shutoff member from its shutting-off position, in order to overcome the aspiration phenomenon which tends to keep the shutoff member in shutting-off position.

However, the flow of water by sprinklers necessarily implies that the shutoff member leaves its shutting-off position and that, consequently, the fusible member allows it to leave this position, and this by blowing.

However, in certain cases, it is desired to be able to trigger the flow of water through sprinklers, even when the temperature in the vicinity of the sprinklers has not reached the threshold at which the fusible member blows. In other terms, it is sought to protect in certain cases, by anticipation, a zone of the site to be protected although the fire is still distant from the zone in question. This can be the case for example for:

protecting shelving, by creating a protection perimeter around the shelving;

open passages, in order to create a curtain of water;

specific reservoirs to be maintained at temperatures below a predetermined threshold.

SUMMARY

An embodiment of the present disclosure relates to a sprinkler for a firefighting installation including a network of vacuum sprinklers, comprising:

a fixing connector, that allows the sprinkler to be connected to pipework, having a nozzle;

a fusible member;

a shutoff member for shutting off the nozzle, held in the shutoff position by the fusible member, characterised in that said fusible member is kept bearing against the shutoff member by a moveable bearing means, capable of allowing the shutoff member to leave its shutting-off position when the pressure in the nozzle exceeds a predetermined pressure, and in that it comprises means for ejecting the shutoff member mounted outside the nozzle and acting in a pulling sense on the shutoff member.

As such, a sprinkler according to the invention allows for the flow of water even in the presence of the fusible member that has not blown, this under the effect of the pressure of the water present in the nozzle of the sprinkler once the installation is triggered, as shall be explained in more detail in what follows.

In other terms, a sprinkler according to the invention makes it possible to obtain a flow of water on a zone to be protected by anticipation with respect to a fire distant from the zone or, in any case, that has not caused the blowing of the sprinkler or sprinklers present in the zone to be protected by anticipation.

Of course, a sprinkler according to the invention can also operate in a conventional manner, i.e. by allowing for the flow of water once the fusible member has blown, having been subjected to a temperature exceeding a predetermined threshold.

Note that a sprinkler according to the invention can be installed in the same way as the other sprinklers present on the installation, and therefore do not require any adaptation or transformation of the installation.

Moreover, the means for ejecting the shutoff member are provided in the framework of a conventional operation of the sprinkler according to which the fusible member blows after having been subjected to a temperature higher than a predetermined threshold.

Indeed, in "vacuum" systems, an aspiration phenomenon of the air is produced in the pipework inside the installation. However, the shutoff member, if it is not forced to leave its location, still remains somewhat "glued" on the mouth of the nozzle of the connector, which then does not allow the air to enter and consequently prevents the actuator from being triggered.

Means for ejecting are therefore mounted on each sprinkler in order to prevent this. According to an advantageous solution, the means for ejecting are mounted outside the duct and act in a pulling sense on the shutoff member.

As such, after the blowing of the fusible member of a sprinkler, the complete release of the nozzle of the sprinkler is obtained.

Two characteristics are indeed combined in order to obtain this result, namely:

the fact that the spring is mounted outside the nozzle, and therefore is not in a position to hinder the intake of air into the pipework of the installation;

the spring acts in a pulling sense on the shutoff member, which provides for its extraction and its ejection from the sprinkler.

This results in that the vacuum is not in any case slowed down with a sprinkler according to the invention and in that, consequently, the triggering and the release of water with a "vacuum" system is of the most reactive in all circumstances. For the purposes of information, the triggering time is about 5 seconds.

According to a preferred embodiment, the moveable bearing means takes the form of a piston.

In this case, as the sprinkler comprises in a manner known per se a yoke extending from the nozzle to an orifice end opposite the duct in relation to fusible member, the piston is advantageously guided in sliding in said orifice.

In such a configuration, a tube is advantageously made integral with the yoke in said orifice, with the piston being mounted slidingly in said tube, an elastically deformable means being present in the tube in order to allow for the displacement of the piston.

Preferentially, the elastically deformable means is a compression spring.

Of course, other means for allowing the displacement of the piston can be considered without leaving the scope of the invention.

According to an advantageous solution, the sprinkler comprises means for ejecting the shutoff member.

According to a particular embodiment, the means for ejecting comprise at least one torsion spring.

Such a torsion spring makes it possible to effective achieve the desired result, by having the advantage of being able to be mounted easily in a small space.

According to a preferred embodiment, the shutoff member has, outside the nozzle a flared flange, with a limb of a torsion spring being placed under the flange.

BRIEF DESCRIPTION OF THE DRAWINGS

Other characteristics and advantages of the invention shall appear more clearly when reading the following description of a preferred embodiment, given by way of example for the purposes of information and non-restricted, and of the annexed drawings among which.

DETAILED DESCRIPTION OF ILLUSTRATIVE EMBODIMENTS

Figure 1:
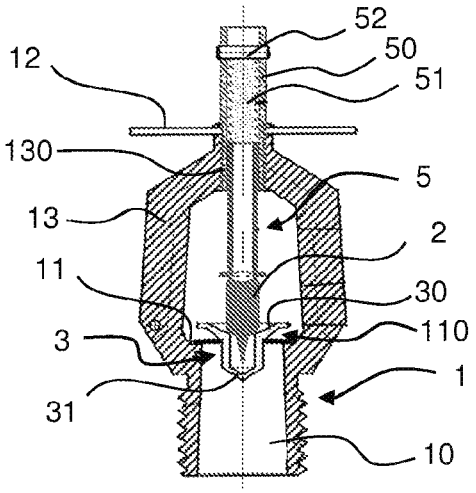
FIG. 1 diagrammatically shows, as a longitudinal cross-section, a sprinkler according to the invention.
Figure 2:
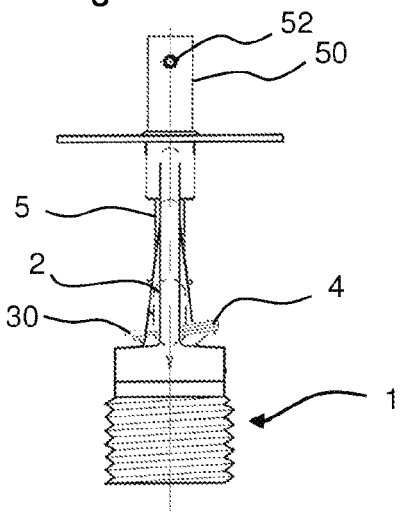
FIG. 2 diagrammatically shows the side of a sprinkler according to the invention.

Such as shown in FIGS. 1 and 2, a sprinkler according to the invention comprises:

- a fixing connector 1, presenting an external thread making it possible to screw the latter on a pipework having a complementary thread, for the purpose of connecting the sprinkler to the pipework, with the connector having a nozzle 10 intended to communicate with the inside of the pipework;
- a fusible member 2, constituted in practice by an ampoule enclosing a liquid and an air bubble provided, according to the conventional technique of fusible members used on sprinklers, to expand and cause the bursting of the ampoule if the temperature to which the fusible member is subjected exceeds a predetermined threshold;
- a shutoff member 3 for shutting off the nozzle 10;
- a deflector 12 fixed on a yoke 13 made integral with the connector 1 of the sprinkler.

According to the principle of the invention, the fusible member 2 is kept bearing against the shutoff member 3 by a moveable bearing means capable of allowing the shutoff member to leave its shutting-off position when the water pressure in the nozzle 10 exceeds a predetermined pressure. Of course, the fact that the water arrives in the nozzle with a pressure that is sufficient to push back the shutoff member implies that the installation is triggered, i.e. that at least one other sprinkler has its fusible member blown.

According to this embodiment, the moveable bearing means takes the form of a piston 5 capable of being displaced longitudinally towards the end of the sprinkler opposite the nozzle, this under the effect of the pressure of the water present where applicable in the nozzle and being exerted on the base 31 of the shutoff member 3.

The sprinkler according to this embodiment according to the invention further comprises:

- a tube 50 fixedly mounted in the orifice 130 of the yoke present at the end opposite the nozzle in relation to fusible member;
- a spring 51 inserted into the tube 50;
- a pin 52, forming a travel stop for the spring 51.

The piston 5 is mounted slidingly in the tube 50 which as such forms a means for guiding the sliding of the piston.

In addition, the spring constitutes an elastically deformable means present in the tube in order to allow for the displacement of the piston, with the spring 4 being mounted in compression inside the tube under the constraint of the piston 5 bearing on the fusible member 2.

A sprinkler according to the invention is intended particularly to be integrated into a "vacuum" installation, of which the principle was described in the patent document published under number FR-2 724 323.

According to a known principle of this type of installation, the putting into service of such an installation calls for placing the network of sprinklers under vacuum, with a vacuum as such also being present in a line that leads to a trip device. As long as a vacuum is present in this line, the trip device keeps under pressure with water a control chamber of a general valve, which maintains the latter in a closed position. If the fusible member of one of the sprinklers blows, the network of sprinklers is placed under atmospheric pressure, which also propagates to the level of the line of the trip device, which switches the state of the trip device, which then authorises the drop in pressure in the control chamber of the general valve. This causes the opening of the latter and the filling with water of the network of sprinklers.

When the network of sprinklers is filled with water, the operation of the sprinkler according to the invention is as follows.

The water pressure that is exerted in the nozzle 10 pushes on the base 31 of the shutoff member 3, which in turn pushes back the fusible member and piston 5 unit towards the inside of the tube, inside of which the piston slides, this against the force exerted by the spring. Of course, the spring is calibrated in such a way as to exert a force on the piston less than the pressure of the water being exerted on the piston by the intermediary of the shutoff member of the fusible member.

The mobility of the piston therefore authorises the shutoff member to be displaced upwards according to the position of the sprinkler shown in FIG. 1. This results in that the shutoff member releases the orifice from the nozzle, which authorises the flow of water by the sprinkler in consideration.

In other terms, thanks to a sprinkler according to the invention, the flow of water is authorised even when the fusible member has not blown.

According to another characteristic of the invention, the sprinkler further comprises means for ejecting mounted outside the nozzle 10 and acting in a pulling sense on the shutoff member 3. Of course, as long as the fusible member 2 is in place, the latter exerts a force that is greater than the force of the pulling of the means for ejecting.

Figure 3:
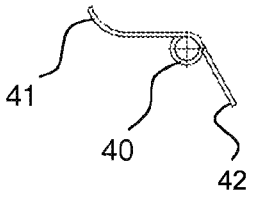
FIGS. 3 to 5 diagrammatically show a torsion spring intended to be provided on a sprinkler according to the invention, respectively viewed from above in untensioned state, viewed from above in tensioned state and viewed from the side.
Figure 4:
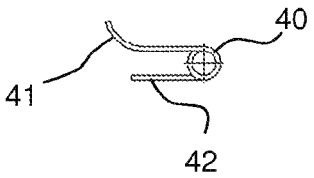
Figure 5:
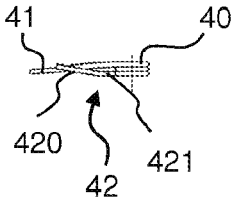

According to this embodiment, the means for ejecting are constituted of a spring, and more precisely a torsion spring 4, such as shown in FIGS. 3 to 5.

Such as shown in these figures, the spring 4 comprises:

a winding 40, of one or several coils;

a first limb 41 extending from the winding 40, and intended to cooperate with the shutoff member;

a second limb extending from the winding 40, and intended to be retained on the sprinkler.

In untensioned state, the spring 4 has a configuration wherein the limbs 41 and 42 are separated from one another, such as shown in FIG. 3, while, in tensioned state, the two limbs 41 and 42 are brought closer to one another, such as shown in FIG. 4. In tensioned state, according to the operating principle of a torsion spring, the limbs 41 and 42 tend to exert a force on the elements that retain them in this position, in order to return to their respective positions that correspond to the untensioned state, such as shown in FIG. 3 in untensioned state.

Such a spring is therefore intended to cooperate via one of its limbs (here limb 41) with the shutoff member for the purpose of ejecting the latter from the sprinkler after the blowing of the fusible member 2.

According to this embodiment, the shutoff member 3 has a flange 30 extending outside the nozzle 10 and having a flared shape.

The shutoff member 3 is kept bearing against a washer 11 mounted at the end of the nozzle 10. The flared flange 30 of the shutoff member arranges a space 110 with the washer 11.

The spring 4 is mounted on the sprinkler in such a way that one of its limbs (here the limb 41) is placed in the space 110, i.e. between the flared flange 30 and the washer 11 of the sprinkler. More precisely, the space 110 between the flange 30 and the washer 11 is provided in such a way that the corresponding limb of the spring is caught in this space once the fusible member is installed. The spring is therefore kept in complete safety in standby position.

An exemplary embodiment of the present application proposes a sprinkler of the type intended for "vacuum" installations, which allows the flow of water when the network of sprinklers is filled with water, even when the fusible member has not blown.

An exemplary embodiment provides such a sprinkler which is easy to implement and to install without adaptation or transformation of the installation.

Although the present disclosure has been described with reference to one or more examples, workers skilled in the art will recognize that changes may be made in form and detail without departing from the scope of the disclosure and/or the appended claims.

The invention claimed is:

1. A sprinkler for a firefighting installation including a network of vacuum sprinklers, comprising:

a fixing connector, that allows the sprinkler to be connected to pipework, having a nozzle;

a fusible member;

a shutoff member for shutting off the nozzle, held in shutoff position by the fusible member;

a moveable bearing, which keeps said fusible member bearing against the shutoff member, and which is capable of allowing the shutoff member to leave its shutting-off position when pressure in the nozzle exceeds a predetermined pressure; and an ejecting element, which ejects the shutoff member mounted outside the nozzle and acts in a pulling sense on the shutoff member.

2. The sprinkler according to claim 1, wherein the moveable bearing takes the form of a piston.

3. The sprinkler according to claim 2 comprising a yoke extending from the nozzle to an orifice opposite the nozzle in relation to the fusible member, wherein the piston is guided in sliding in said orifice.

4. The sprinkler according to claim 3, wherein a tube is made integral with the yoke in said orifice, with the piston being mounted slidingly in said tube, with an elastically deformable means being present in the tube in order to allow for the displacement of the piston.

5. The sprinkler according to claim 4, wherein the elastically deformable means comprises a spring mounted in compression.

6. The sprinkler according to claim 1, wherein said ejecting element comprises at least one torsion spring.

7. The sprinkler according to claim 6, wherein said at least one torsion spring has a winding from which extend two limbs, of which one limb which cooperates with the shutoff member, with the connector having a means for retaining the other limb of the torsion spring.

8. The sprinkler according to claim 7, wherein the shutoff member has, outside the nozzle, a flared flange, with a limb of the torsion spring being placed under the flange.

* * * * *